US010125465B2

(12) United States Patent
Blanks et al.

(10) Patent No.: US 10,125,465 B2
(45) Date of Patent: Nov. 13, 2018

(54) INTERCONNECTING MEMBERS AND METHODS OF INTERCONNECTING UNITS

(71) Applicants: Bari G. Blanks, Belle Chasse, LA (US); Francis J. Lobrano, Belle Chasse, LA (US)

(72) Inventors: Bari G. Blanks, Belle Chasse, LA (US); Francis J. Lobrano, Belle Chasse, LA (US)

( * ) Notice: Subject to any disclaimer, the term of this patent is extended or adjusted under 35 U.S.C. 154(b) by 358 days.

(21) Appl. No.: 14/212,212

(22) Filed: Mar. 14, 2014

(65) Prior Publication Data

US 2014/0369768 A1 Dec. 18, 2014

Related U.S. Application Data

(60) Provisional application No. 61/783,412, filed on Mar. 14, 2013.

(51) Int. Cl.
*E02D 29/02* (2006.01)
*E02D 17/20* (2006.01)
*E02D 5/16* (2006.01)

(52) U.S. Cl.
CPC ..... *E02D 5/16* (2013.01)

(58) Field of Classification Search
CPC ... E02D 29/02; E02D 29/025; E02D 29/0266; E02D 29/0291; E02D 17/205; E04B 1/4178; E04B 1/4185; E04B 1/48; E04B 1/483; E04B 1/49; Y10T 24/42; Y10T 24/44026; Y10T 24/4578; Y10T 24/497; F16B 21/02; F16B 15/0023; F16B 15/0053; F16B 15/0069; F16B 15/0076
USPC ..... 405/284, 286, 287; 52/285.1, 379, 562, 52/564, 582.1, 604, 712
See application file for complete search history.

(56) References Cited

U.S. PATENT DOCUMENTS 3,123,389 A * 3/1964 Biesecker ..... F16B 5/10 292/218
3,190,167 A * 6/1965 Holton ..... F16B 2/20 411/349
6,237,970 B1 * 5/2001 Joannou ..... E05B 65/006 292/241
6,540,463 B2 * 4/2003 Ward ..... F16B 37/042 411/173
2005/0005566 A1 * 1/2005 Kim ..... E02D 29/0225 52/719
2007/0110522 A1 * 5/2007 Kim ..... E02D 17/205 405/284

(Continued)

FOREIGN PATENT DOCUMENTS

WO WO 0235027 A1 * 5/2002 ..... E04B 2/16

*Primary Examiner* — Benjamin F Fiorello
*Assistant Examiner* — Stacy N Lawson
(74) *Attorney, Agent, or Firm* — Jason P. Mueller; Adams and Reese LLP

(57) ABSTRACT

Connector plates having improved protrusions with flat surfaces facing lateral forces to increase stability and strength. Top flat surfaces are aligned with the back edge of the plate and bottom flat surfaces are aligned with the front edge of the plate. The connector plates may be used to install or erect a retaining wall, containment system, levy or a similar structure. The connector plates may have spike apertures allowing for the installation of additional spikes to further increase strength and resistance to lateral forces.

8 Claims, 11 Drawing Sheets

(56) References Cited

U.S. PATENT DOCUMENTS

| | | | | |
|---|---|---|---|---|
| 2009/0304458 | A1* | 12/2009 | Chang | E02B 3/127 405/284 |
| 2010/0212559 | A1* | 8/2010 | Chang | E02D 17/20 111/200 |
| 2010/0272540 | A1* | 10/2010 | Bucker | F16B 21/086 411/549 |
| 2012/0027528 | A1* | 2/2012 | Alfreds | E02D 17/20 405/284 |
| 2012/0167520 | A1* | 7/2012 | Thomson | E02B 3/127 52/712 |

* cited by examiner

INTERCONNECTING MEMBERS AND METHODS OF INTERCONNECTING UNITS

CROSS-REFERENCE TO RELATED APPLICATIONS

The present application claims the benefit of U.S. Provisional Patent Application Ser. No. 61/783,412 filed on Mar. 14, 2013, which is incorporated herein by reference hereto.

FIELD OF INVENTION

The present disclosure relates generally to interconnecting members. In exemplary though non-limiting embodiments, the present disclosure relates to connector plates having improved protrusions and to methods of interconnecting units with improved connector plates.

BACKGROUND INFORMATION

Retaining walls, containment systems, levies and similar structures are commonly used in a variety of applications, such as erosion control, flood protection, coastal protection, slope stabilization for slopes and embankments of highways and railways, or in areas where the landscape needs to be shaped severely. Generally, these structures are subject to substantial lateral pressures from the soil, backfill, water, etc. maintained behind the structures. These pressures are predominantly horizontal and tend push the structure forward (and potentially over) if not properly addressed.

Structures are commonly built with sandbags and/or soil bags. Where sandbags or soil bags are utilized, lateral pressures apply forces against back surfaces of the bags such that each row of bags may have a tendency to slide forward over the bags of a row below. Essentially, bags on top are pushed forward over bags on bottom. Accordingly, structures should be designed to provide shear strength to resist sliding and prevent failures.

Methods to provide additional stability and resistance against lateral pressures of structures made from sandbags and/or soil bags may include interconnecting members to connect the bags. Typically, interconnecting members will be plate-like structures having a plurality of protrusions from both a top surface and a bottom surface of the plate-like structures. The interconnecting members will usually be placed across adjacent bags of a first row of the structure with a bag of the next row covering the interconnecting member. The top protrusions will protrude into the top bag and the protrusions on the bottom will protrude into portions of the adjacent bags below the interconnecting member. The process may be continued until the desired height of the structure is obtained. This process will essentially interconnect the bags and provides stability. The structures may further incorporate sheets of geogrid to further stabilize the structure and the geogrid may be anchored to individual units of the structure via interconnecting members.

Generally, the plurality of protrusions of the interconnecting members may be spikes, cones or similar protrusions. The protrusions are generally the same on either side of the plate-like structures, and for most interconnecting members, the top surface and the bottom surface are interchangeable. Because typical protrusions are merely spikes, cones, or similar, the protrusions have angular sides or edges in multiple directions with respect to their interaction with the bags. Because the lateral forces are generally essentially horizontal, the forces push against the protrusion at an angle rather than against a flat surface thereby reducing stability and resistance against the applied forces. The angular sides and/or edges lead to decreased shear resistance and susceptibility to sliding of the bags.

Accordingly, there is need for improved interconnecting units that provide increased shear strength/sliding resistance and enhanced stability to the protrusions thereof.

SUMMARY

According to an example embodiment of the present disclosure, a connector plate is provided having: a planar structure, comprising: a front edge; a back edge substantially parallel to the front edge; a first side edge substantially perpendicular to the front edge and the back edge; a second side edge substantially parallel to the first side edge; a top surface; and a bottom surface; a plurality of top protrusions extending from the top surface of the planar structure, comprising: a top flat surface portion substantially perpendicular to the top surface of the planar structure and substantially parallel to the back edge; a top rib portion extending from a center of the top flat surface portion and toward the front edge; a plurality of bottom protrusions extending from the bottom surface of the planar structure, comprising: a bottom flat surface portion substantially perpendicular to the bottom surface of the planar structure and substantially parallel to the front edge; and a bottom rib portion extending from a center of the bottom flat surface portion and toward the back edge. The top flat surface portions of the plurality of top protrusions are aligned in the direction of the back edge and the bottom flat surface portions of the plurality of bottom protrusions are aligned in the direction of the front edge.

The connector plate may further include notches incorporated into the top rib portions near the top surface of the planar structure. The connector plate may further include notches incorporated into the bottom rib portions near the bottom surface of the planar structure. The top flat surface portions of the plurality of top protrusions may not be vertically aligned with the bottom flat surface portions of the plurality of bottom protrusions. The top flat surface portions of the plurality of top protrusions may be vertically aligned with the bottom flat surface portions of the plurality of bottom protrusions.

A single piece of material may pass through an aperture in the planar surface to provide a top flat surface portion and a bottom flat surface portion of a pairing of a top protrusion and a bottom protrusion. The connector plate may further include rib extensions extending from a portion of the top and bottom rib portions and configured to secure the top and bottom rib portions via rib extension apertures located in the planar structure. The connector plate may further include a plurality of spike apertures configured to receive and secure a plurality of spikes.

Each of the plurality of spike apertures may have a substantially circular center portion and a plurality of extensions. The connector plate may include a plurality of locking apertures located in the planar structure around the center portions of the plurality of spike apertures and configured to receive locking extensions extending from the plurality of spikes. Each of the plurality of spikes may include: a base configured to pass through the plurality of spike apertures; a spike extension extending vertically above the base and forming a spike protrusion; and first and second wings extending from the spike extension parallel to the base. The spike protrusion may be barbed.

According to an example embodiment of the present disclosure, a connector plate is providing having: a planar structure, at least one top protrusion extending from a top surface of the planar structure, having a top flat surface portion substantially parallel to a back edge of the planar structure and a top rib portion extending from a center of the top flat surface portion and toward the front edge; at least one bottom protrusion extending from a bottom surface of the planar structure, having a bottom flat surface portion substantially parallel to a front edge of the planar structure and a bottom rib portion extending from a center of the bottom flat surface portion and toward the back edge.

The connector plate may have a plurality of spike apertures configured to receive and secure a plurality of spikes. Each of the plurality of spike apertures may include a substantially circular center portion and a plurality of extensions. The connector plate may include a plurality of locking apertures located in the planar structure around the center portions of the plurality of spike apertures and configured to receive locking extensions extending from the plurality of spikes.

According to an example embodiment of the present disclosure, a method of constructing a wall is provided, including: a) placing units into a first row wherein the units are laid side by side; b) placing connectors on the units such that a portion of each connector lies upon portions of two adjacent units; c) adding a second row of units such that each unit covers a connector; d) repeating step b) to c) until a desired height of the wall is obtained. The connectors are connector plates comprising a plurality of top protrusions extending above the connector plates and a plurality of bottom protrusions extending below the connector plates. Top protrusions have flat surfaces facing a back edge of the connector plate and the bottom protrusions have flat surfaces facing a front edge of the connector plate.

The connector plates may include a plurality of spike apertures. The connector plates may include a plurality of removable spikes locked into the plurality of spike apertures. The method of constructing a wall may include installing geogrid within the wall. The units may be bags.

According to an example embodiment of the present disclosure, a system of retaining a substance is provided, including: erecting a retaining structure comprising units and interconnecting members, said interconnecting members having protrusions with flat surfaces opposing horizontal forces from lateral pressures of the retained substance.

DETAILED DESCRIPTION

Figure 1:
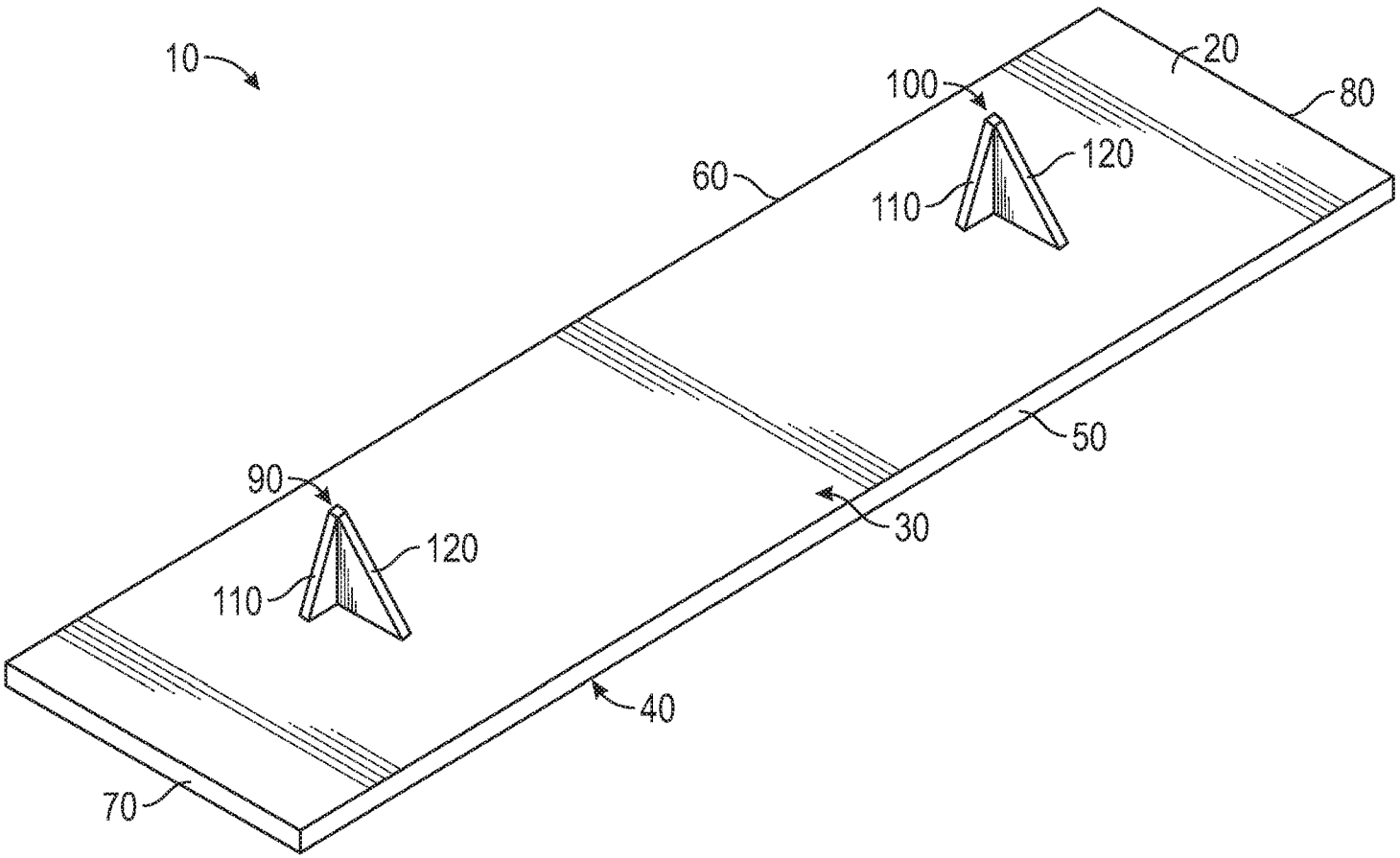
FIG. 1 is a top isometric view of a connector plate, according to an exemplary embodiment of the present disclosure.

Like reference characters denote like parts in the drawings.

In example embodiments, an interconnecting member and methods of connecting units are provided. Embodiments include a connector plate having improved protrusions on a top surface and a bottom surface of the connector plate. Embodiments incorporate protrusions having a flat surface facing an applied force which provides enhanced shear strength and sliding resistance. Embodiments include a support ridge which provides increased stability to the flat surface of the protrusion. Embodiments are configured to provide direction to the flat surfaces of the protrusions such that the flat surface of a top protrusion is substantially parallel to and faces a back edge of the connector plate and a flat surface of a bottom protrusion is substantially parallel to and faces a front edge of the connector plate. Alignment of the flat surfaces increases sliding resistance of the connector plate, thereby enhancing stability of a structure utilizing an embodiment of the present disclosure.

Embodiments of the present disclosure include a notch in a section of a rib portion of the protrusion. Embodiments of the present disclosure have a plurality of spike apertures through a planar surface of the connector plate. The spike apertures may be configured to receive a plurality of spikes, which may be barbed spikes. Embodiments of the present disclosure include barbed spikes configured to attach to a connector plate at a plurality of spike apertures. Embodiments of the present disclosure may be modified to increase the number of protrusions extending from the connector plate. Embodiments of the present disclosure allow a user of the connector plate to insert additional protrusions as needed. Embodiments of the present disclosure provide greater holding strength and stability. Embodiments of the present disclosure are configurable such that additional gripping protrusions may be added to increase holding stability.

FIG. 1 is a top isometric view of an exemplary embodiment of the present disclosure. Connector plate 10 is shown as planar structure 20 substantially rectangular in shape, having a front edge 50, a back edge 60 substantially parallel to front edge 50, a first side edge 70 substantially perpendicular to front edge 50 and back edge 60, and a second side edge 80 substantially parallel to first side edge 70 and substantially perpendicular to front edge 50 and back edge 60. Top surface 30 is shown with a first top protrusion 90 and a second top protrusion 100.

Both first top protrusion 90 and second top protrusion 100 have a flat surface portion 110 and a rib portion 120. Flat surface portion 110 is substantially shaped as an isosceles triangle having a base attached to top surface 30 and two equal sides converging in a point extending vertically from top surface 30 such that a planar surface of flat surface portion 110 is substantially perpendicular to a planar surface of the top surface 30. The base of flat surface portion 110 is substantially parallel to back edge 60. Though described herein as triangular, flat surface portion 110 is not limited to any specific shape or embodiment.

Figure 2:
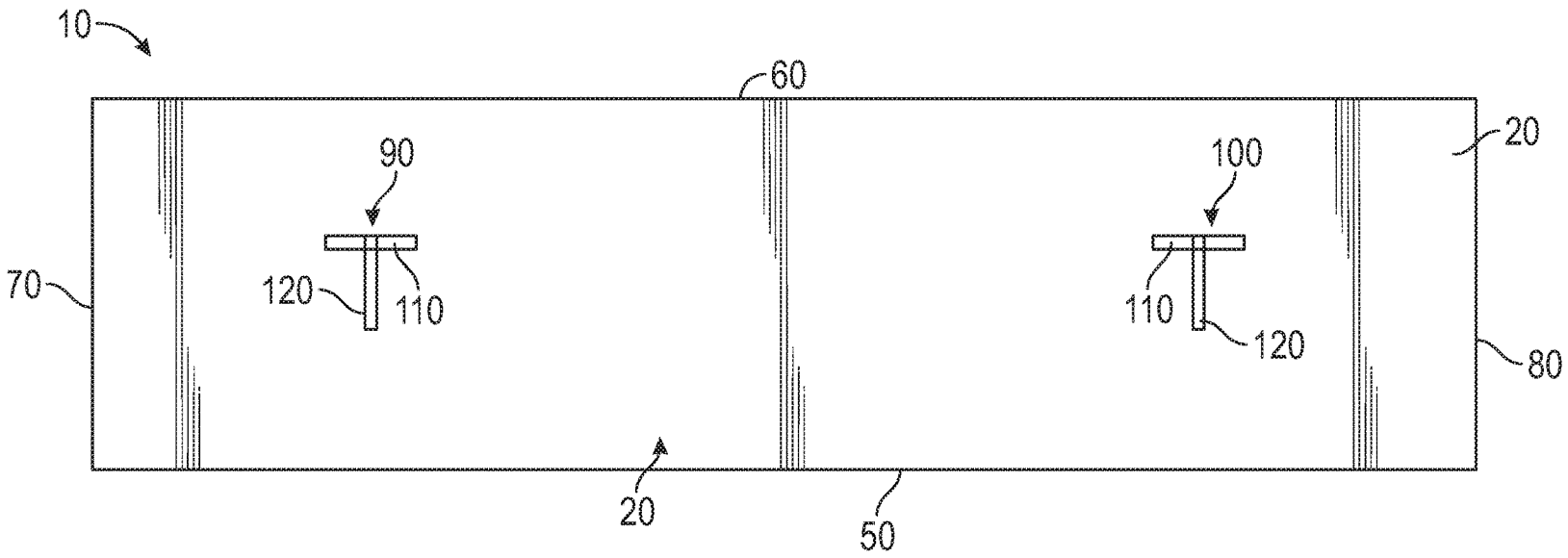
FIG. 2 is a top view of a connector plate, according to an exemplary embodiment of the present disclosure.

Rib portion 120 is substantially shaped as a right triangle having a first leg attached to flat surface portion 110 and a second portion attached to the top surface 30. Rib portion 120 is substantially perpendicular to flat surface portion 110. As shown, rib portion 120 extends from a center of the base of flat surface portion 110 on a front edge side of flat surface 110. Rib portion 120 may incorporate a notch 115 at or near top surface 30 as show in FIGS. 7C and 7D. Notch 115 may be configured such that a point 117 is formed in rib portion 120. When a bag is placed upon rib portion 120, notch 115 grabs into the bag at point 117 providing additional grip and stability. A back edge side of flat surface portion 110 has no rib attached thereto. See, e.g., FIG. 2. The configuration of flat surface portion 110 and rib portion 120 shown in the Figures provides a top protrusion having a flat surface substantially parallel to and facing back edge 60 perpendicular to the planar surface of top surface 30. See, e.g., FIG. 4. Opposite the flat surface, the rib portion provides stability to flat surface portion 110. Though described herein as triangular, rib portion 120 is not limited to any specific shape or embodiment.

Figure 3:
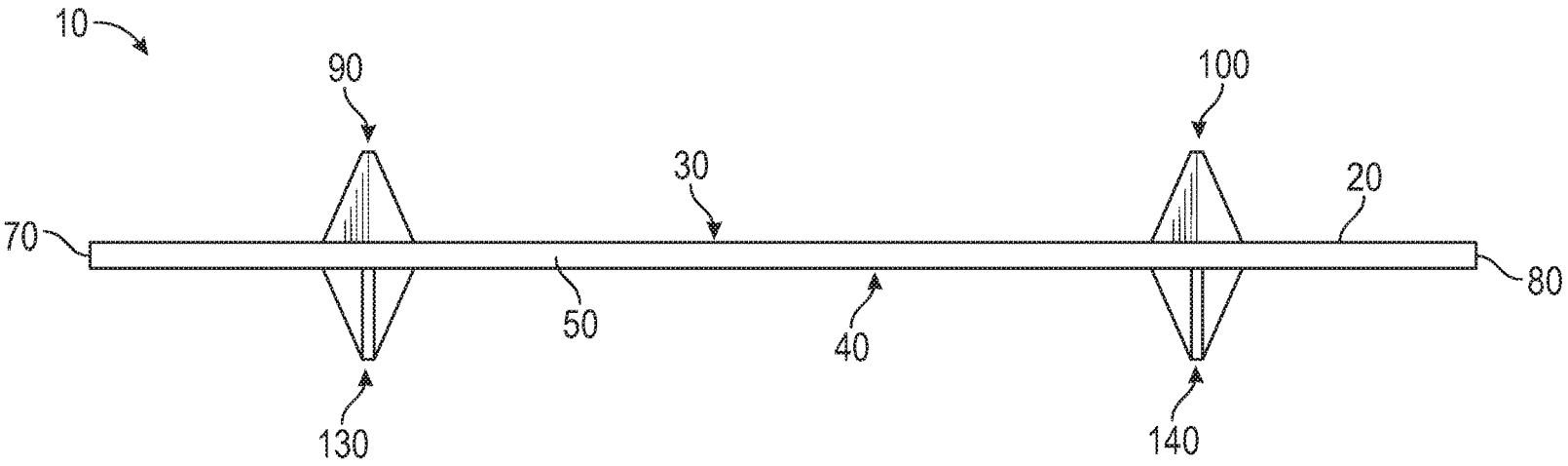
FIG. 3 is a front view of a connector plate, according to an exemplary embodiment of the present disclosure.
Figure 4:
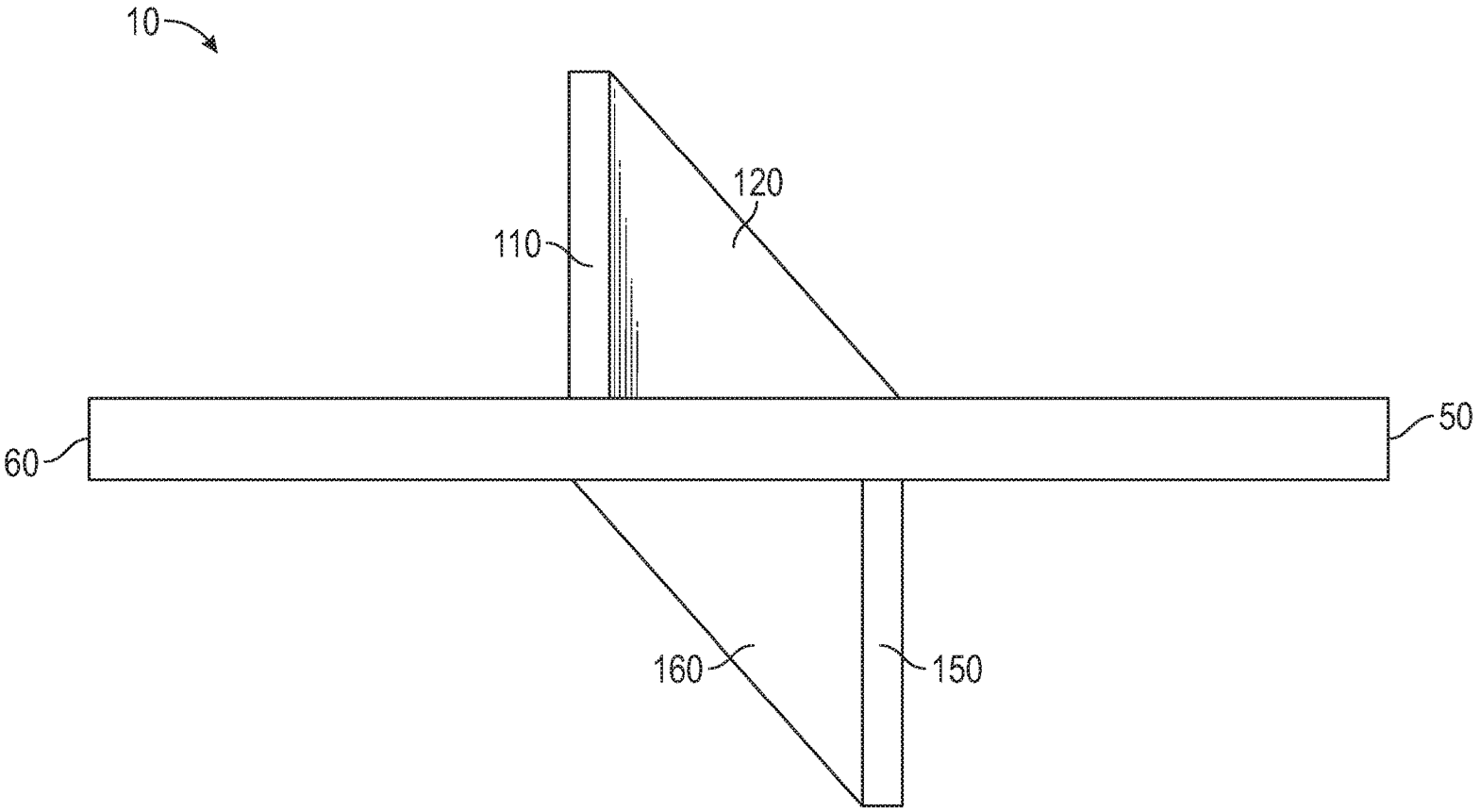
FIG. 4 is a side view of a connector plate, according to an exemplary embodiment of the present disclosure.

The example embodiments in FIGS. 3 and 4, show bottom portion 40 having first and second bottom protrusions 130 and 140. Both first bottom protrusion 130 and second bottom protrusion 140 have a flat surface portion 150 and a rib portion 160. Flat surface portion 150 is substantially shaped as an isosceles triangle having a base attached to bottom surface 40 and two equal sides converging in a point extending vertically below bottom surface 40 such that a planar surface of flat surface portion 150 is substantially perpendicular to a planar surface of the bottom surface 40. The base of flat surface portion 150 is substantially parallel to front edge 50. Though described herein as triangular, flat surface portion 150 is not limited to any specific shape or embodiment.

Rib portion 160 is substantially shaped as a right triangle having a first leg attached to flat surface portion 150 and a second portion attached to the bottom surface 40. Rib portion 160 is substantially perpendicular to flat surface portion 150. As shown, rib portion 160 extends from a center of the base of flat surface portion 150 on a back edge side of flat surface 150. Rib portion 160 may incorporate a notch 155 at or near bottom surface 40 as show in FIGS. 7C and 7D. Notch 155 may be configured such that a point 157 is formed in rib portion 160. When a bag is placed upon rib portion 160, notch 155 grabs into the bag at point 157 providing additional grip and stability. A front edge side of flat surface portion 150 has no rib attached thereto. See, e.g., FIG. 4. The configuration of flat surface portion 150 and rib portion 160 shown in the Figures provides a protrusion having a flat surface substantially parallel to and facing front edge 50 perpendicular to the planar surface of bottom surface 40. See, e.g., FIG. 4. Opposite the flat surface, the rib portion provides stability to flat surface portion 150. Though described herein as triangular, rib portion 160 is not limited to any specific shape or embodiment.

In certain embodiments of the present disclosure, first and second top protrusions 90 and 100 may be aligned with first and second bottom protrusions 130 and 140 such that flat surface portion 110 and flat surface portion 150 are offset. See, e.g., FIG. 4. In other embodiments of the present disclosure, first and second top protrusions 90 and 100 may be aligned with first and second bottom protrusions 130 and 140 such that flat surface portion 110 and flat surface portion 150 are aligned. See, e.g., FIGS. 7C and 7D. Flat surface portion 110 and flat surface portion 150 may be a single piece of material partially passed through an aperture in planar surface 20. In exemplary embodiments of the present disclosure, rib portions 120 and 160 may include extensions 205 configured to be secured into apertures in planar structure 20. See, e.g., FIG. 7D.

Figure 5:
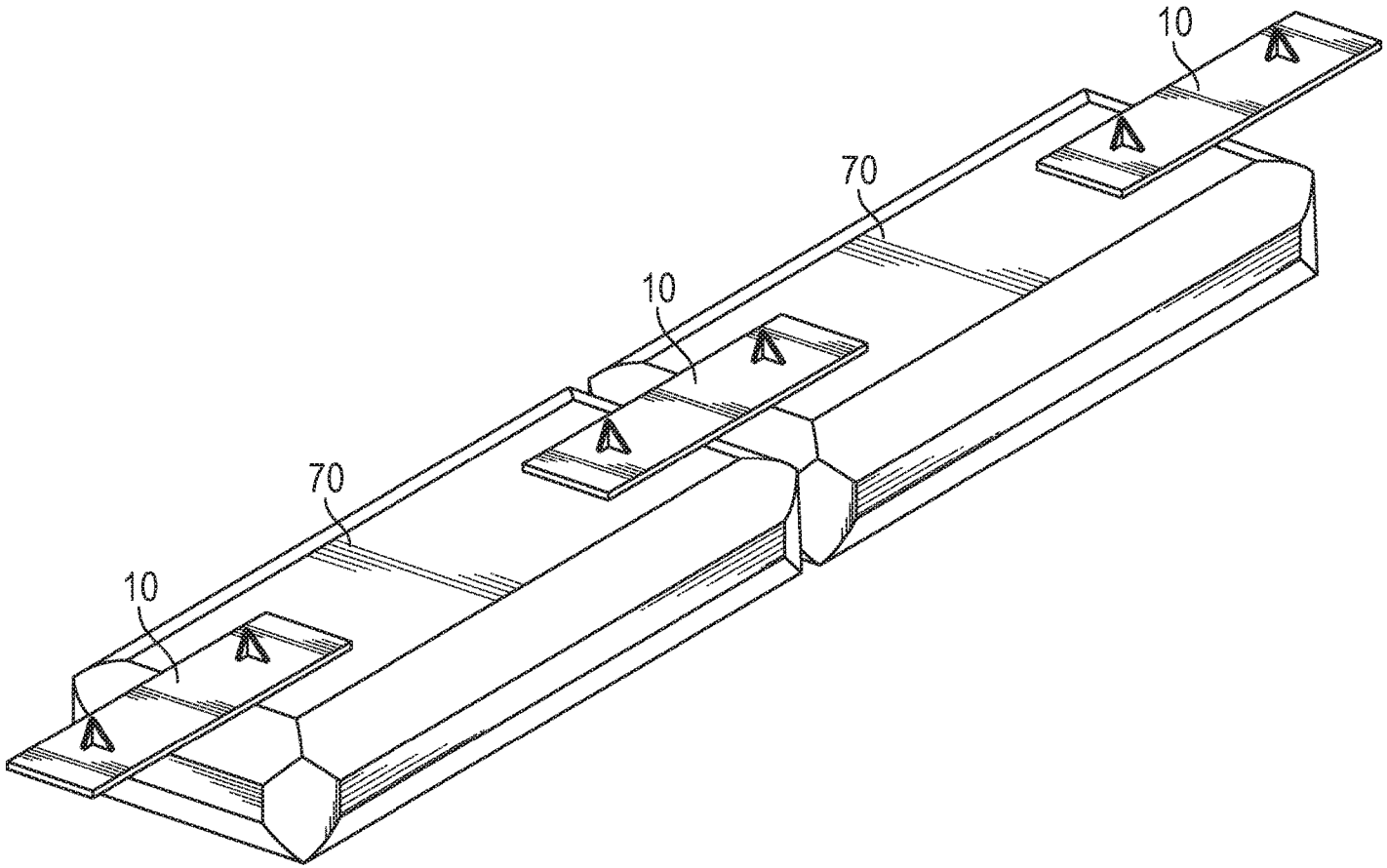
FIG. 5 is a top isometric view of connector plates installed above adjacent bags, according to an exemplary embodiment of the present disclosure.
Figure 6:
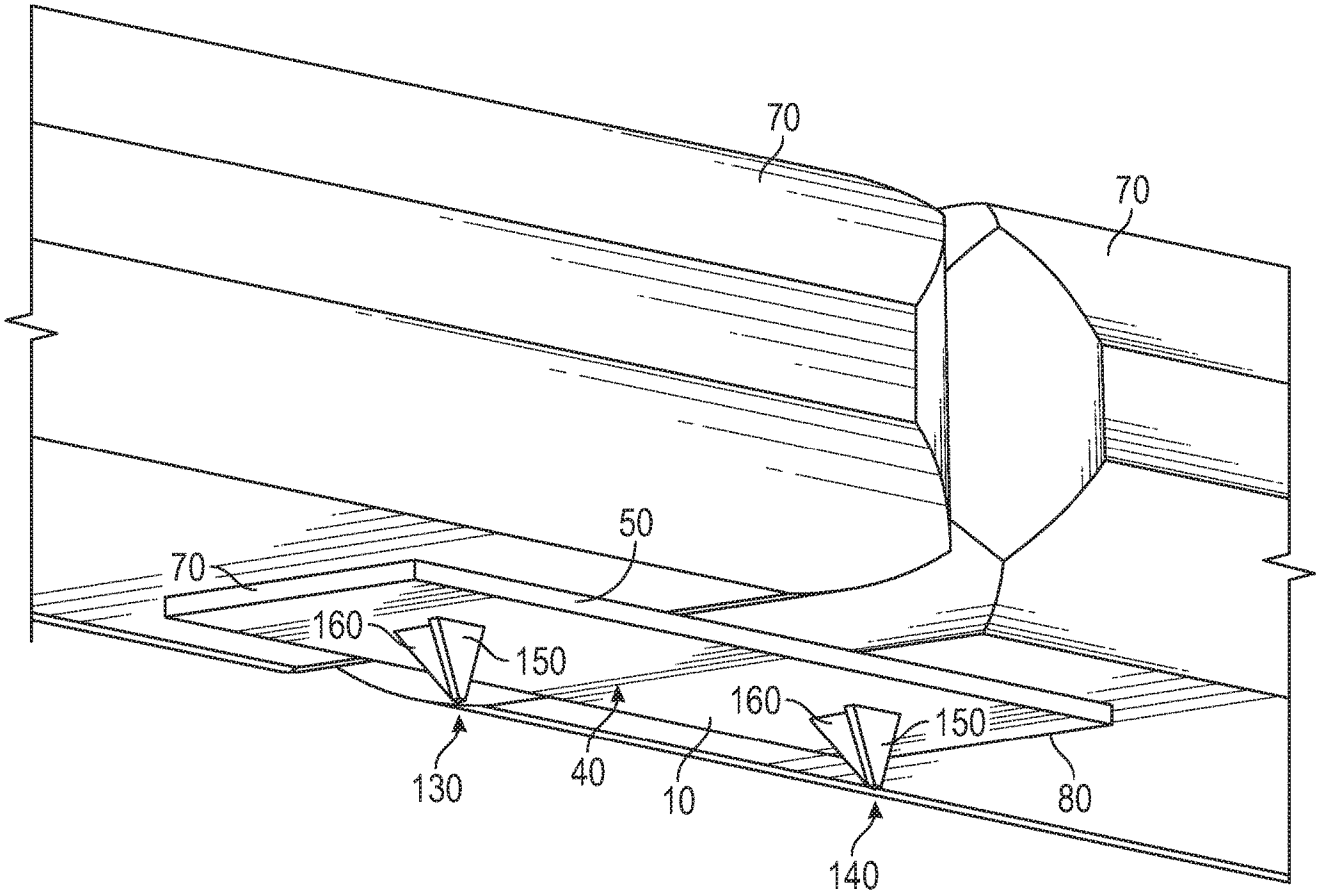
FIG. 6 is a bottom isometric view of a connector plate installed beneath adjacent bags, according to an exemplary embodiment of the present disclosure.

FIGS. 5 and 6 show embodiments of the present disclosure installed on wall units. As shown, connector plate 10 is aligned such that front edge 50 is substantially parallel to a front edge of the wall units and back edge 60 is substantially parallel to a back edge of the wall units. FIG. 5 shows embodiments installed on a top surface of the wall units, which may be a first row of a wall or structure. As shown, in alignment, the flat surface of top protrusions 90 and 100 face the back edge of the wall units. FIG. 6 further shows that the flat surfaces of bottom protrusions 130 and 140 face the front edge of the wall units. Having the flat surfaces of the top protrusions face the back edge and the flat surfaces of the bottom protrusions face the front edge provides substantial improved stability and slide resistance over traditional connector units. Under typical conditions, lateral pressures apply a horizontal force pushing bags forward tending to slide higher bags forward over surfaces of lower bags. The present invention provides flat surfaces directly opposing the forces applied by the lateral pressures rather than an angular surface thereby maximizing resistance to the forces. Accordingly, the present invention substantially increases stability in the wall or structure.

Figure 7:
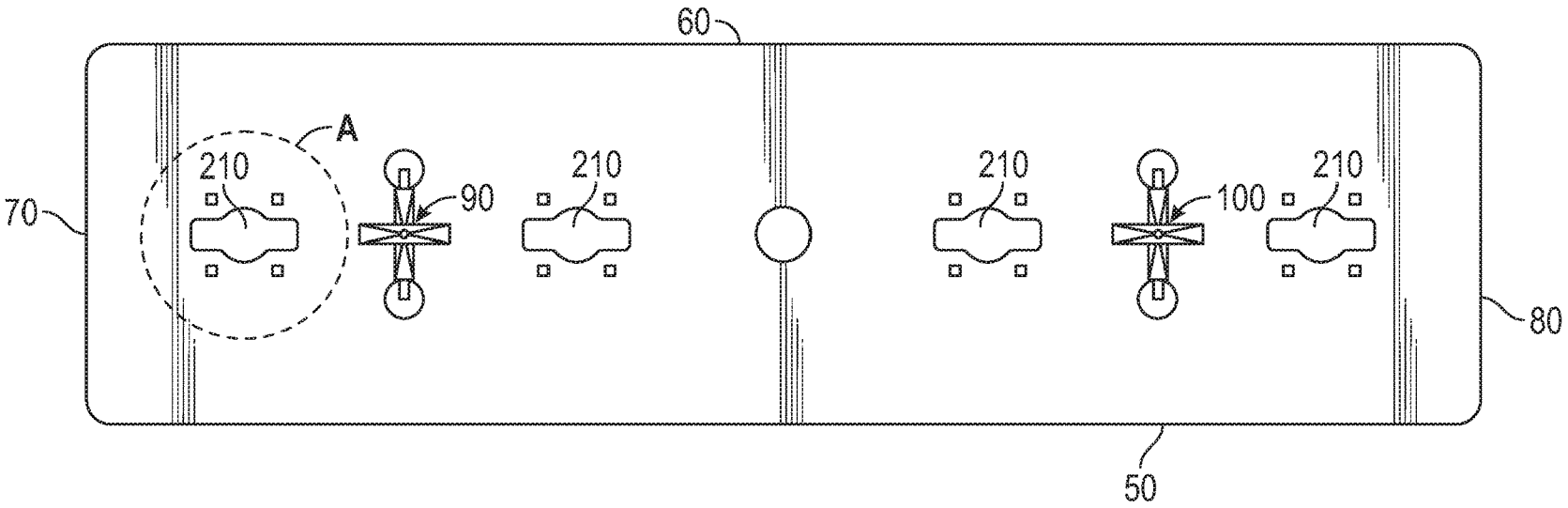
FIG. 7 is a top view of a connector plate, according to an exemplary embodiment of the present disclosure.
Figure 7A:
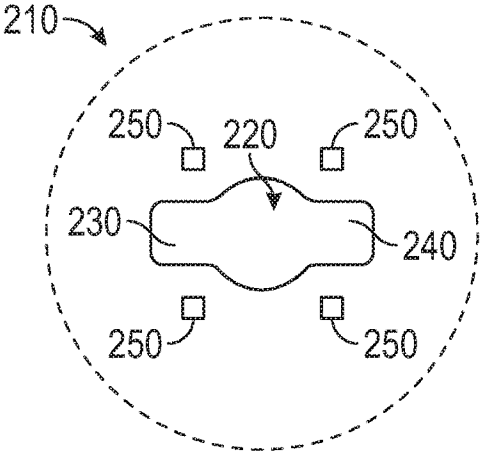
FIG. 7A is a top view of circumference A of the connector plate shown in FIG. 7.
Figure 7B:
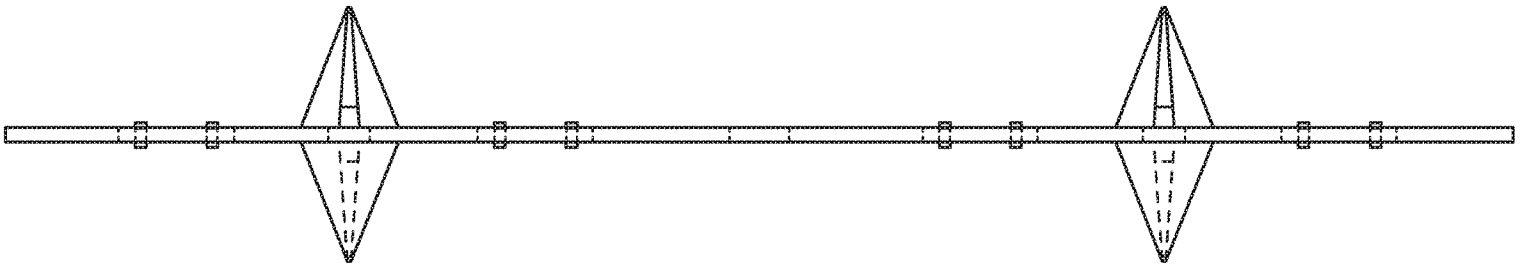
FIG. 7B is a front view of the connector plate shown in FIG. 7.
Figure 7C:
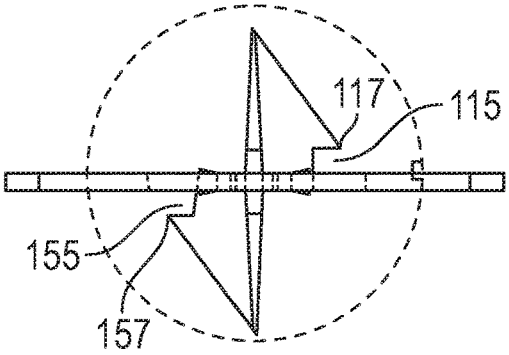
FIG. 7C is a side view of the connection plate shown in FIG. 7.
Figure 7D:
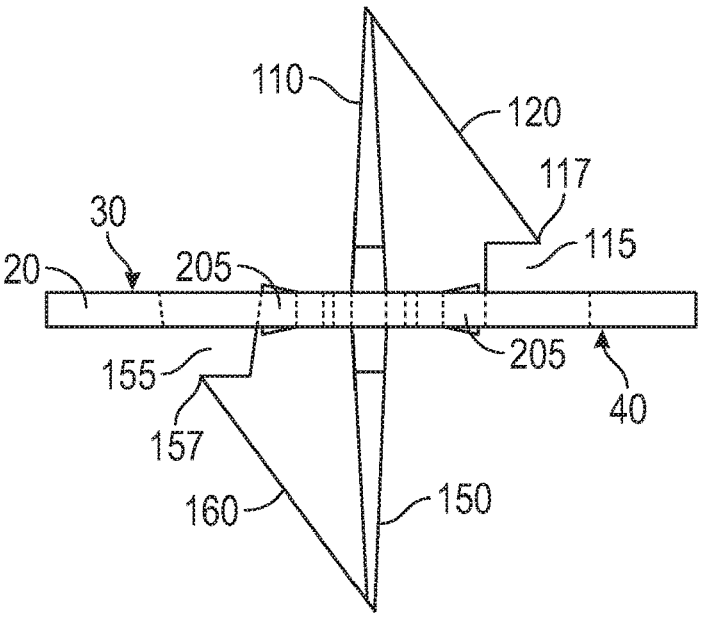
FIG. 7D is a side view of the connector plate shown in FIG. 7.
Figure 7E:
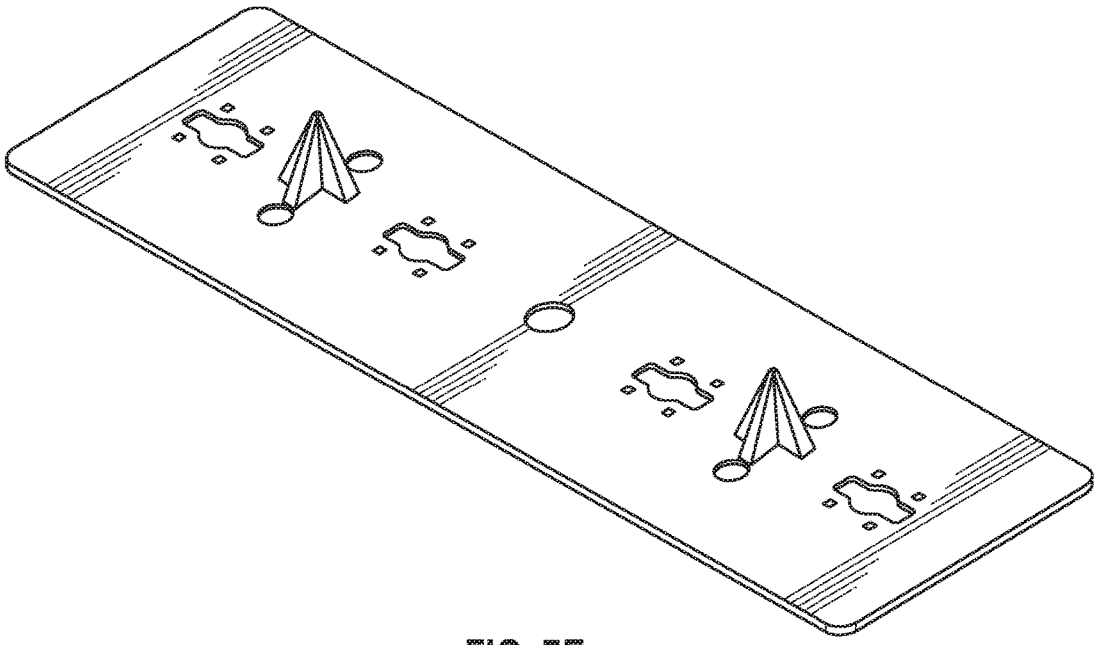
FIG. 7E is an isometric view of the connector plate shown in FIG. 7.
Figure 9:
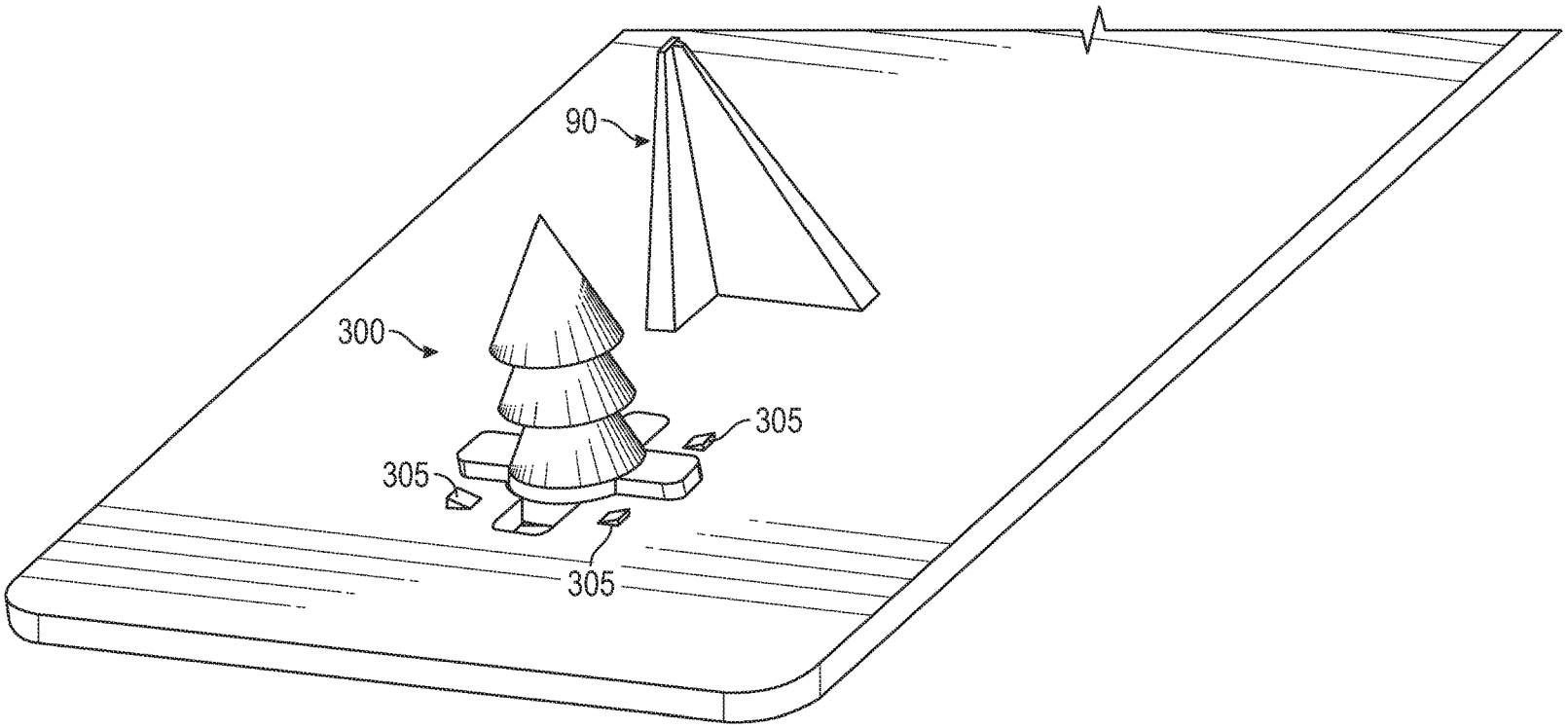
FIG. 9 is an isometric view of a portion of a connector plate having a barbed spike installed therein, according to an exemplary embodiment of the present disclosure.

FIGS. 7 and 7E show an exemplary embodiment of the present disclosure having a plurality of spike apertures 210 configured to receive and secure a plurality of spikes 300. Spike apertures 210 include a substantially circular center portion 220 and first and second extensions 230 and 240 extending towards first side edge 70 and second side edge 80, respectively. See, e.g., FIG. 7A. Although shown with first and second extensions 230 and 240 aligned towards first and second side edges 70 and 80, additional extensions may be included and the extensions may have different alignments. Spike aperture 210 may include a plurality of locking apertures 250 placed around center portion 220. See, e.g., FIG. 7A. The plurality of locking apertures 250 may be configured to receive a plurality of locking extensions 305 of spike 300. See, e.g., FIG. 9.

Figure 8:
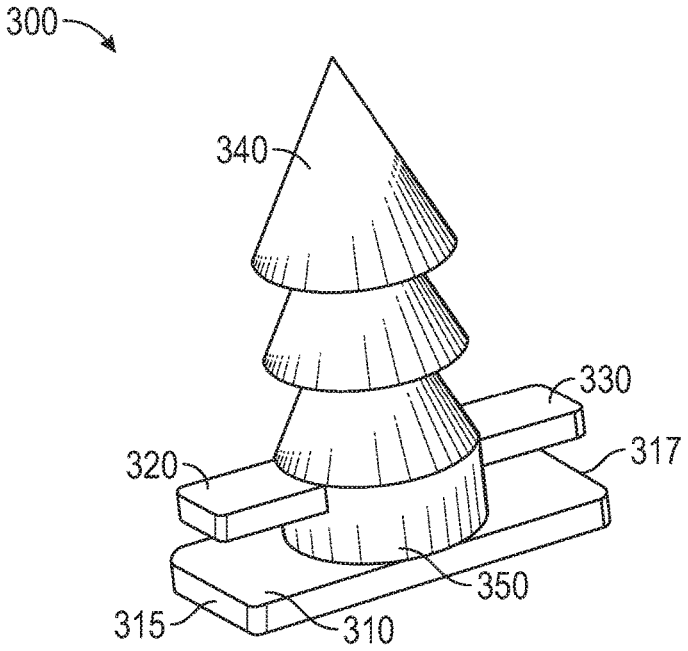
FIG. 8 is an isometric view of a barbed spike, according to an exemplary embodiment of the present disclosure.

Embodiments of the present disclosure may incorporate a plurality of spikes 300. As shown in FIG. 8, spike 300 has a base 310, which may be substantially rectangular, configured to pass through spike aperture 210. Spike extension 350 extends vertically above base 310 and forms spike protrusion 340, which may be a barbed structure of overlapped conical forms (see, e.g., FIG. 8) or other barbed formations. Spike extension 350 may have a total length of approximately 1 inch and may be approximately ½ inch in diameter. Spike extension 350 includes first and second wings 320 and 330 that extend horizontally from spike extension 350 substantially parallel to base 310. First and second wings 320 and 330 may be configured such that first wing 320 extends in a same direction as a first side 315 of base 310 and second wing 330 extends in a same direction as second side 317 of base 310. Base 310 may include a plurality of locking extensions 305. See, e.g., FIG. 9.

In embodiments of the present disclosure, spike 300 is configured such that base 310 may be passed through spike aperture 210 when first side 315 of base 310 is aligned with first extension 230 and second side 317 of base 310 is aligned with second extension 240. Spike 300 may be passed through spike aperture 210 until all of base 310 is out of plane with planar structure 20 but before first and second wings 320 and 330 are in plane with planar structure 20. Spike 300 may then be rotated within spike aperture 210 such that a portion of planar structure 20 lies between base 310 and first and second wings 320 and 330. In certain embodiments, spike 300 may be rotated until locking extensions 305 engage locking apertures 250, locking spike 300 into place inside spike aperture 210.

Although shown with four spike apertures 210, more or less spike apertures may be incorporated into the connector plate. The plurality of spike apertures 210 allow a plurality of spikes 300 to be installed therein. A user may install spikes 300 in each of the spike apertures 210, none of the spike apertures 210, or any combination in between. Spikes 300 may be added to a connector plate as needed to increase holding stability. Embodiments of the present disclosure incorporating a plurality of spike apertures 210 allow a user to configure the connector plates as needed thereby providing flexibility and increased stability where needed without incorporating additional materials/cost when not needed.

Embodiments of the present disclosure may be constructed in various parts; or, alternatively, embodiments may be formed as a single piece. Embodiments may be formed from any suitable material, including non-corrodible metals, plastics or other polymers. Embodiments may be formed from carbon fibers which may provide increased strength and resistance to various destructive elements that the connector may be subjected to such as salt water. Though shown as substantially rectangular, embodiments of the connector plate may be of various shapes. Connector plates may be dimensioned such that first and second bottom protrusions may protrude into adjacent bags when installed.

Embodiments of the present invention include methods of constructing retaining walls, containment systems, levies and/or similar structures with units and connectors. The units may be bags, which may be soil bags or sand bags. The connectors may be connector plates having first and second top protrusions on a top surface of the connector and first and second bottom protrusions on a bottom surface of the connector. First and second top protrusions may have flat surfaces facing a back edge of the connector and rib portions opposite the flat surfaces. First and second bottom protrusions may have flat surfaces facing a front edge of the connector and rib portions opposite the flat surfaces. Bags may be laid adjacent to one another to form a first row of a wall or structure. The connectors may then be placed on top surfaces of the bags of the first row such that one of the first and second bottom protrusions protrudes into each of two adjacent bags. A second row of bags may be added such that a bag covers a connector with the first and second top protrusions protrude into a bottom surface of the bag. This procedure may be repeated until a desired height of the structure is achieved. Alternate configurations and/or arrangement may be employed when connecting units to create a structure or wall.

Embodiments of the present invention include a system of retaining soil, water, or other substances behind a structure. In certain embodiments a system of preventing erosion is provided. In certain embodiments, a system of erecting a retaining structure is provided incorporating interconnecting members having flat surfaces opposing horizontal forces from lateral pressures of a retained substance.

Embodiments may include geogrid installed in the structure which geogrid may be anchored to units via connector plates. Embodiments may further include rebar installations throughout the structure to further stabilize the structure. Rebar may be inserted into a top two layers of a structure. The rebar may be carbon fiber.

While the embodiments are described with reference to various implementations and exploitations, it will be understood that these embodiments are illustrative and that the scope of the inventions is not limited to them. Many variations, modifications, additions, and improvements are possible. Further still, any steps described herein may be carried out in any desired order, and any desired steps may be added or deleted. Support for the present invention may be found in the attached documents and figures, all of which are expressly incorporated herein in their entirety by reference thereto.

What is claimed is:

1. A connector plate for securing sand or soil bags to one another, the connector plate comprising:

a planar structure, including:
- a front edge;
- a back edge substantially parallel to the front edge;
- a first side edge substantially perpendicular to the front edge and the back edge;
- a second side edge substantially parallel to the first side edge;
- a top surface; and
- a bottom surface;

a plurality of top protrusions extending from the top surface of the planar structure, comprising:
- a top flat surface portion substantially perpendicular to the top surface of the planar structure and substantially parallel to the back edge;
- a top rib portion extending from a center of the top flat surface portion and toward the front edge;

a plurality of bottom protrusions extending from the bottom surface of the planar structure, comprising:
- a bottom flat surface portion substantially perpendicular to the bottom surface of the planar structure and substantially parallel to the front edge;
- a bottom rib portion extending from a center of the bottom flat surface portion and toward the back edge;

wherein the top flat surface portions of the plurality of top protrusions are aligned in the direction of the back edge and the bottom flat surface portions of the plurality of bottom protrusions are aligned in the direction of the front edge, and wherein the planar structure has a plurality of spike apertures therethrough;

wherein said connector plate further comprises a plurality of spikes;

wherein each spike aperture is configured to receive one of the plurality of spikes therein;

wherein each of the plurality of spikes comprises a spike protrusion, an upper locking member having two wings, and a bottom base member parallel to the upper locking member;

wherein each of the plurality of spikes is configured such that the bottom base member is capable of being passed through the spike aperture until the bottom base member is below the planar structure and the upper locking member is above the planar structure; and wherein each of the plurality of spikes is further configured to lock into a locked position by rotation of the spike when the bottom base member is below the planar structure and the upper locking member is above the planar structure.

2. The connector plate of claim 1, further comprising: notches incorporated into the top rib portions near the top surface of the planar structure, the notches configured for engaging sand or soil bags.

3. The connector plate of claim 1, further comprising: notches incorporated into the bottom rib portions near the bottom surface of the planar structure, the notches configured for engaging sand or soil bags.

4. The connector plate of claim 1, wherein the top flat surface portions of the plurality of top protrusions are not vertically aligned with the bottom flat surface portions of the plurality of bottom protrusions.

5. The connector plate of claim 1, wherein the top flat surface portions of the plurality of top protrusions are vertically aligned with the bottom flat surface portions of the plurality of bottom protrusions.

6. The connector plate of claim 1, wherein each of the plurality of spike apertures comprises a substantially circular center portion and a plurality of extensions.

7. A connector plate, comprising:

a planar structure, at least one top protrusion extending from a top surface of the planar structure, having a top flat surface portion substantially parallel to a back edge of the planar structure and a top rib portion extending from a center of the top flat surface portion and toward a front edge of the planar structure;

at least one bottom protrusion extending from a bottom surface of the planar structure, having a bottom flat surface portion substantially parallel to the front edge of the planar structure and a bottom rib portion extending from a center of the bottom flat surface portion and toward the back edge, wherein the planar structure includes a plurality of spike apertures configured to receive and secure a spike;

wherein said connector plate further comprises a plurality of spikes;

wherein each of the plurality of spikes comprises a spike protrusion, an upper locking member having two wings, and a bottom base member parallel to the upper locking member;

wherein each of the plurality of spikes is configured such that the bottom base member is capable of being passed through one of the spike apertures until the bottom base member is below the planar structure and the upper locking member is above the planar structure; and wherein each of the plurality of spikes is further configured to lock into a locked position by rotation of the spike when the bottom base member is below the planar structure and the upper locking member is above the planar structure.

8. The connector plate of claim 7, wherein each of the plurality of spike apertures comprises a substantially circular center portion and a plurality of extensions.

* * * * *